US009273907B2

(12) United States Patent
Dinulescu

(10) Patent No.: US 9,273,907 B2
(45) Date of Patent: Mar. 1, 2016

(54) PLATE TYPE HEAT EXCHANGER HAVING OUTER HEAT EXCHANGER PLATES WITH IMPROVED CONNECTIONS TO END PANELS

(76) Inventor: Mircea Dinulescu, Voorburg (NL)

( * ) Notice: Subject to any disclaimer, the term of this patent is extended or adjusted under 35 U.S.C. 154(b) by 388 days.

(21) Appl. No.: 13/641,556

(22) PCT Filed: Apr. 14, 2011

(86) PCT No.: PCT/NL2011/050252

§ 371 (c)(1),
(2), (4) Date: Nov. 20, 2012

(87) PCT Pub. No.: WO2011/129695

PCT Pub. Date: Oct. 20, 2011

(65) Prior Publication Data

US 2013/0062042 A1 Mar. 14, 2013

(30) Foreign Application Priority Data

Apr. 16, 2010 (NL) ..... 2004565

(51) Int. Cl.
*F28F 9/007* (2006.01)
*F28D 9/00* (2006.01)
*F28F 9/00* (2006.01)

(52) U.S. Cl.
CPC ..... *F28D 9/0037* (2013.01); *F28F 9/001* (2013.01); *F28F 2265/26* (2013.01)

(58) Field of Classification Search
CPC ..... F28D 9/0031; F28D 9/0037; F28F 9/007; F28F 9/0075; F28F 2265/26
USPC ..... 165/148, 149, 152, 165, 166, 81–83
See application file for complete search history.

(56) References Cited

U.S. PATENT DOCUMENTS 2,462,421 A * 2/1949 Pitt ..... 165/81
3,216,732 A * 11/1965 Foust ..... 277/647

(Continued)

FOREIGN PATENT DOCUMENTS

DE 10 2007 056182 5/2008
DE 10 2006 060603 6/2008

(Continued)

OTHER PUBLICATIONS

International Search Report dated Dec. 7, 2011, corresponding to PCT/NL2011/050252.

*Primary Examiner* — Allen Flanigan
*Assistant Examiner* — For K Ling
(74) *Attorney, Agent, or Firm* — Hoyng Rokh Monegier LLP; Ramin Amirsehhi; David P. Owen

(57) ABSTRACT

A plate type heat exchanger (102) includes a heat exchanger assembly (104), end panels (106) and end panel connection members (107) connecting the end panels (106). The heat exchanger assembly (104) has a stack of heat exchanger plates (112) and a pair of outer heat exchanger plates (114) located on opposing sides of the heat exchanger assembly (104). At least one outer heat exchanger plate (114) is mechanically connected to an adjacent end panel (106) and has an outer main surface portion (122) facing the adjacent end panel (106) that is thermally connected to an end panel contacting region (125) of the adjacent end panel (106). The in-plane thermal expansion properties of the outer main surface portion (122) are identical to in-plane thermal expansion properties of the end panel contacting region (125).

19 Claims, 5 Drawing Sheets

(56) References Cited

U.S. PATENT DOCUMENTS

| | | | | | |
|---|---|---|---|---|---|
| 3,986,549 | A | * | 10/1976 | Huggins et al. | 165/82 |
| 4,308,915 | A | * | 1/1982 | Sanders et al. | 165/166 |
| 4,442,886 | A | | 4/1984 | Dinulescu | |
| 4,688,631 | A | * | 8/1987 | Peze et al. | 165/166 |
| 4,805,695 | A | * | 2/1989 | Ishikawa et al. | 165/166 |
| 5,082,050 | A | | 1/1992 | Darragh | |
| 5,383,516 | A | * | 1/1995 | Dinulescu | 165/82 |
| 5,699,856 | A | * | 12/1997 | Merle | 165/166 |
| 6,516,874 | B2 | * | 2/2003 | Mathur et al. | 165/166 |
| 7,740,056 | B2 | * | 6/2010 | Watanabe | 165/157 |
| 7,896,064 | B2 | * | 3/2011 | Fulmer | 165/157 |
| 8,955,578 | B2 | * | 2/2015 | Kwon et al. | 165/76 |
| 2003/0116305 | A1 | * | 6/2003 | Beddome et al. | 165/81 |
| 2010/0006274 | A1 | * | 1/2010 | Cho | 165/166 |
| 2011/0017436 | A1 | * | 1/2011 | Cho | 165/166 |

FOREIGN PATENT DOCUMENTS

| | | |
|---|---|---|
| DE | 10 2007 003099 | 7/2008 |
| EP | 1 788 341 | 5/2007 |

* cited by examiner

PLATE TYPE HEAT EXCHANGER HAVING OUTER HEAT EXCHANGER PLATES WITH IMPROVED CONNECTIONS TO END PANELS

TECHNICAL FIELD

The present invention relates to a plate type heat exchanger.

BACKGROUND

A conventional plate type heat exchanger generally consists of a plurality of heat exchanger plates, forming spatially separated but thermally connected fluid channels through which fluid streams with a different temperature are allowed to flow. This enables heat transfer to take place from the hotter fluid to the colder fluid.

From U.S. Pat. No. 5,383,516 a plate type heat exchanger is known, having a heat exchanger assembly or core consisting of heat exchanger plates, which is enclosed within a rigid frame consisting of corner beams and end panels. Elastic seals are provided between the core and the casing. Four sealing elements are provided between the core and the corner beams, in order to prevent leakage of fluids that are supplied to the fluid channels. Furthermore, two pairs of sealing elements are provided between the core and the top and bottom end panels.

The disadvantage of the known heat exchanger is that the latter sealing elements are indispensable in the connection between the heat exchanger core and the frame, due to the expected differential thermal expansion between the heat exchanger core and the frame during use. The construction and mounting of these sealing elements is a delicate and error-prone process, increasing the costs of production and maintenance.

SUMMARY

It is an object to provide a plate type heat exchanger for which construction is simplified, while considering the differential thermal expansion properties between the heat exchanger assembly and the frame, and retaining the heat exchanger performance. This object is achieved by a plate type heat exchanger, comprising a heat exchanger assembly, end panels and end panel connection members connecting the end panels. The heat exchanger assembly comprises a stack of heat exchanger plates and a pair of outer heat exchanger plates located on opposing sides of the heat exchanger assembly. The end panels are located near the opposing sides of the heat exchanger assembly. At least one outer heat exchanger plate is mechanically connected to an adjacent end panel and has an outer main surface portion that is facing the adjacent end panel and is substantially entirely thermally connected to an end panel contacting region of the adjacent end panel. The in-plane thermal expansion properties of the outer main surface portion are substantially identical to in-plane thermal expansion properties of the end panel contacting region.

Advantageously, such a plate type heat exchanger has outer heat exchanger plates that are in thermal equilibrium with their adjacent end panels, particularly while in use. The thermal contact between the outer heat exchanger plate and the end panel, in combination with the negligible differences between the in-plane thermal expansion properties of these elements, has the result that the in-plane differential thermal expansion between the outer heat exchanger plate and the contacting end panel region is expected to be negligible. In this way, no additional elastic elements are necessary in the connection of the heat exchanger assembly to the end panels of the plate type heat exchanger.

In a further embodiment, the plate type heat exchanger the end panel connection members comprise corner beams connecting the end panels in corner beam connecting regions. The heat exchanger further has at least one flexible corner plate with a first corner plate connection region that is mechanically connected to the end panel near the respective corner beam connection region. In addition, the flexible corner plate has a second corner plate connection region that is mechanically connected to an outer main surface corner region of the outer heat exchanger plate. The first corner plate connection region and the second corner plate connection region are non-coinciding.

Due to the addition of flexible corner plates as intermediate means of attachments having non-coinciding first and second connection regions connected to the outer main surface corner region and the end panel, the corners of the heat exchanger plates and assembly are allowed to deform in a direction perpendicular to the end panel. Transverse differential thermal expansion between the heat exchanger assembly and a corner beam occurring during operation of the plate type heat exchanger is thereby allowed, without causing permanent damage to the flexible corner plate or the heat exchanger as a whole.

In yet a further embodiment, the flexible corner plate is mechanically connected to the outer heat exchanger plate along a corner plate traversing line region, and mechanically connected to the end panel along a corner plate peripheral line region. Here, an in-plane distance between a farthermost point on the corner plate traversing line region and any point on the corner plate peripheral line region is maximized for all points on the corner plate peripheral line region.

By maximizing the in-plane distance for all points on the corner plate peripheral line region, the allowed deformation between a beam and the nearest corner of the heat exchanger assembly—resulting from differential thermal expansion perpendicular to the end panels—is maximized

BRIEF DESCRIPTION OF THE DRAWINGS

Embodiments will now be described, by way of example only, with reference to the accompanying schematic drawings in which corresponding reference symbols indicate corresponding parts, and in which.

The figures are only meant for illustrative purposes, and do not serve as restriction of the scope or the protection as laid down by the claims.

DETAILED DESCRIPTION

Figure 1:
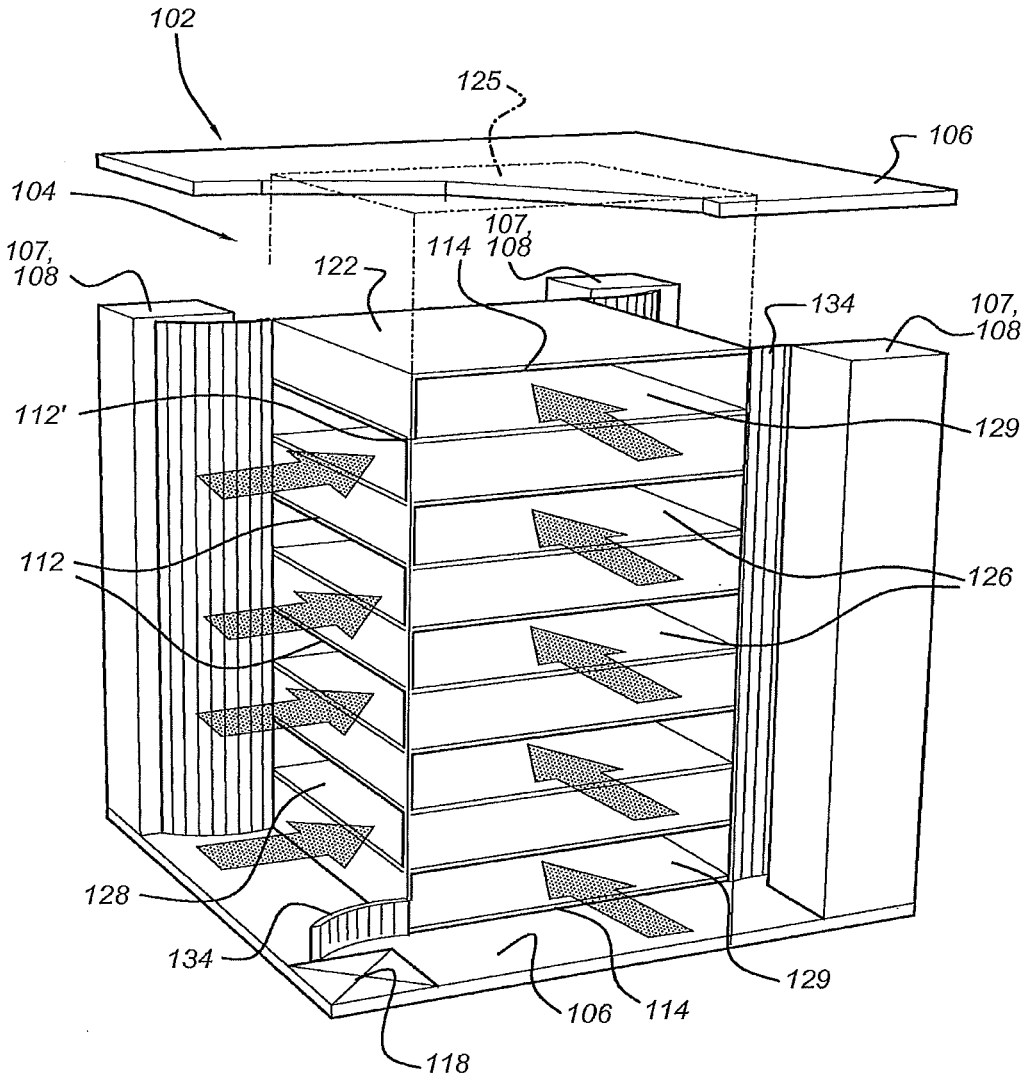
FIG. 1 schematically shows a perspective view of a plate type heat exchanger according to an embodiment.

FIG. 1 schematically shows a perspective view of one embodiment of the plate type heat exchanger 102. The plate type heat exchanger 102 comprises a heat exchanger assembly 104, end panels 106 and end panel connection members 107 connecting the end panels 106. In general, the end panel connection members 107 may be arranged to connect the end panels 106 in various regions of the end plates 106. In the embodiment of FIG. 1, the end panel connection members 107 comprise corner beams 108 connecting the end panels 106 in corner beam connecting regions 118.

The heat exchanger assembly 104 comprises a stack of heat exchanger plates 112 and a pair of outer heat exchanger plates 114 located on opposing sides of the heat exchanger assembly 104. The heat exchanger plates 112 and outer heat exchanger plates 114 are shown in a mutually spaced and parallel configuration.

Further shown are the end panels 106, which are located near the opposing sides of the heat exchanger assembly 104. The end panels 106 are depicted parallel to the outer heat exchanger plates 114. The end panels 106 may be structurally reinforced plates, protecting the outer surfaces of the heat exchanger 102. The end panel connection members 107 may be sufficiently rigid to support the weight of the assembly and/of the end panels 106, without appreciable deformation (e.g. shortening, torsion or buckling). Each corner beam 108 shown in FIG. 1 connects the end panels 106 in corner beam connecting regions 118, resulting in a frame structure in which the heat exchanger assembly can be mounted.

At least one of the outer heat exchanger plates 114 is mechanically connected to an adjacent end panel 106 and has an outer main surface portion 122 that is substantially entirely thermally connected to an end panel contacting region 125 of the adjacent end panel 106. The in-plane thermal expansion properties of the outer main surface portion 122 are substantially identical to in-plane thermal expansion properties of the end panel contacting region 125. During operation of the heat exchanger 102, the outer heat exchanger plate 114 and the end panel 106 are in thermal contact. Due to the comparable thermal expansion properties in the planes of the outer main surface portion 122 and the end panel 106, the expected deformation during operation of these components due to heating is comparable. The resulting differential thermal expansion, i.e. variance in the heat-induced rates of expansion for the two distinct objects, is therefore negligible.

The term "negligible" is used here to indicate an in-plane differential expansion of up to about 0.1%. The outer heat exchanger plate 114 may then have sufficient flexibility in order to accommodate to the resulting small deformation, without being damaged.

In practice, some difference between the operating temperatures and/or the thermal expansion properties of the end panel 106 and the outer heat exchanger plate 114 may be acceptable. Common construction materials for the end panels 106 as well as the heat exchanger plates 112, 114 are various types of steel, with thermal expansion coefficients $\alpha$ typically ranging from $1.3\cdot10^{-5}$ to $1.8\cdot10^{-5}$ $K^{-1}$. For example, if the end panel 106 and the outer heat exchanger plate 114 both have a equal to $1.8\cdot10^{-5}$ $K^{-1}$, then a 50° C. temperature difference between the end panel 106 and the outer heat exchanger plate 114 will yield an in-plane differential thermal expansion of approximately 0.1%. Such a temperature difference may typically occur in a heat exchanger 102 with an operating temperature of over 500° C.

If the joined end panel 106 and outer heat exchanger plate 114 have slightly different thermal expansion coefficients $\alpha$, then the maximum operating temperature may be limited accordingly. For example, for an end panel 106 of carbon steel with $\alpha=1.8\cdot10^{-5}$ $K^{-1}$ and an outer heat exchanger plate 114 of stainless steel with $\alpha=1.5\cdot10^{-5}$ $K^{-1}$, the in-plane differential expansion may be kept within the acceptable bounds by limiting the maximum operating temperatures of the heat exchanger 102. Below an operating temperature of 200° C., the temperature difference between the end panel 106 and outer heat exchanger plate 114 is typically small, e.g. 5-10° C.

As a result of the negligible differential thermal expansion, no additional elastic sealing elements are required for obtaining a leak-proof attachment of the outer heat exchanger plate 114 to the end panel 106.

Sealing between the outer main surface portion 122 of the outer heat exchanger plate 114 and the end panel contacting region 125 may be achieved by welding the outer main surface portion 122 to the end panel 106.

Although not required, the outer heat exchanger plates 114 may have a different geometry compared to the other (inner) heat exchanger plates 112. This will be further illustrated with reference to FIGS. 2A-3B. For convenience, the heat exchanger plates in the assembly 104 that are nearest to the outer heat exchanger plates 114 are further indicated as adjacent heat exchanger plates 112'.

As shown in FIG. 1, the heat exchanger 102 may have multiple fluid channels for conveying the fluids that exchange thermal energy during operation. The heat exchanger plates 112 form first fluid channels 126 and second fluid channels 128. Furthermore, the outer heat exchanger plate 114 and an adjacent heat exchanger plate 112' that is nearest to the outer heat exchanger plate 114 form an outer fluid channel 129. As said, these first fluid channels 126, second fluid channels 128 and outer fluid channels 129 constitute spatially separated and thermally connected conduits for conveying the fluids.

The heat exchanger assembly 104 shown in FIG. 1 is referred to as a cross-flow plate type heat exchanger assembly. A cross-flow plate type heat exchanger assembly has fluid channels 126 that are perpendicular to the second fluid channels 128, having channel apertures that are alternately located at adjacent faces of the heat exchanger assembly 104. The technical features disclosed here are not restricted to the illustrated cross-flow configuration, but may also be applied to other heat exchanger types, for example based on concurrent or counter flow principles and/or having a U-type of Z-type configuration.

In the cross-flow type heat exchanger shown in FIG. 1, the first and second fluid channels 126, 128 open up on different sides of the heat exchanger assembly 104. These first and second fluid channels 126,128 can be classified into two distinct channel groups, which are connectable to distinct supply and discharge channels for fluid streams having different temperatures. For the configuration shown in FIG. 1, the outer fluid channels 129, which are located nearest to the end panels 106, may belong to the channel group of first fluid channels 126. Alternatively, the outer fluid channels 129 may belong to the channel group of second fluid channels 128. In both situations, the same type of fluid will flow through both the outer fluid channels 129.

Alternatively, one outer fluid channel 129 may belong to the group of first fluid channels 126, while the remaining outer fluid channel 129 belongs to the group of second fluid channels 128. For a cross flow heat exchanger having this configuration, the two outer fluid channels 129 will be located on different sides of the heat exchanger assembly 104 (not depicted).

According to an embodiment, the plate type heat exchanger 102 has a sealing means 134, which is provided between a corner beam 108 and the heat exchanger assembly 104. This sealing means 134 extends between the end panels 106 and along the corner beam 108. The purpose of the sealing means 134 is to prevent leakage between the fluid streams having different temperatures and flowing in the distinct channel groups. Thus, the fluids will remain confined and flow within their intended fluid channels 126, 128, 129.

Sealing means 134 may be provided between each corner beam 108 and specific regions of the heat exchanger assembly 104. FIG. 1 shows the sealing means 134 as convex bellows, each being attached between a corner beam 108 and a rib of the box-shaped heat exchanger assembly 104. These bellows are directed along the first fluid channels 126 and the outer fluid channel 129, which in FIG. 1 is closest to the end panel 106. In an alternative embodiment (not shown), the convex bellows may be directed along the second fluid channels 128. Other types of sealing means 134 are conceivable.

The preferred connection of fluid channels 126, 128, 129 to hot or cold fluid supply and discharge channels, as well as the preferred orientation of the sealing means 134 will be determined by the desired operating conditions of the heat exchanger by methods known to the skilled person.

FIG. 2

Figure 2A:
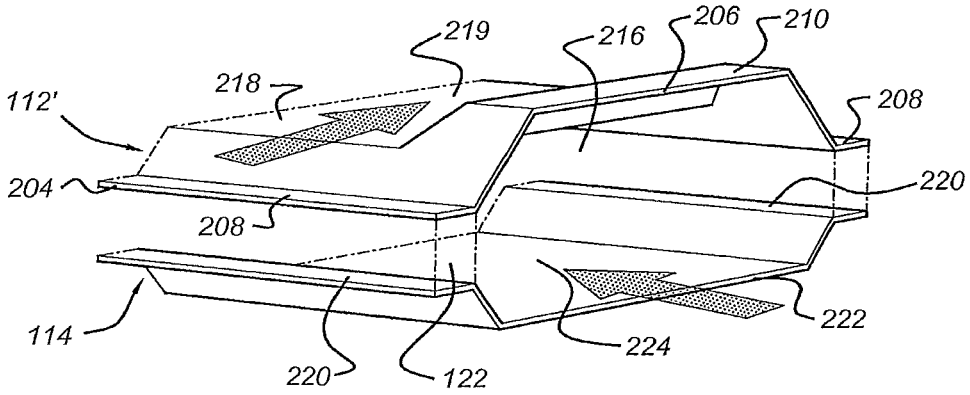
FIGS. 2A and 2B present perspective views of heat exchanger plates in a heat exchanger according to an embodiment.
Figure 2B:
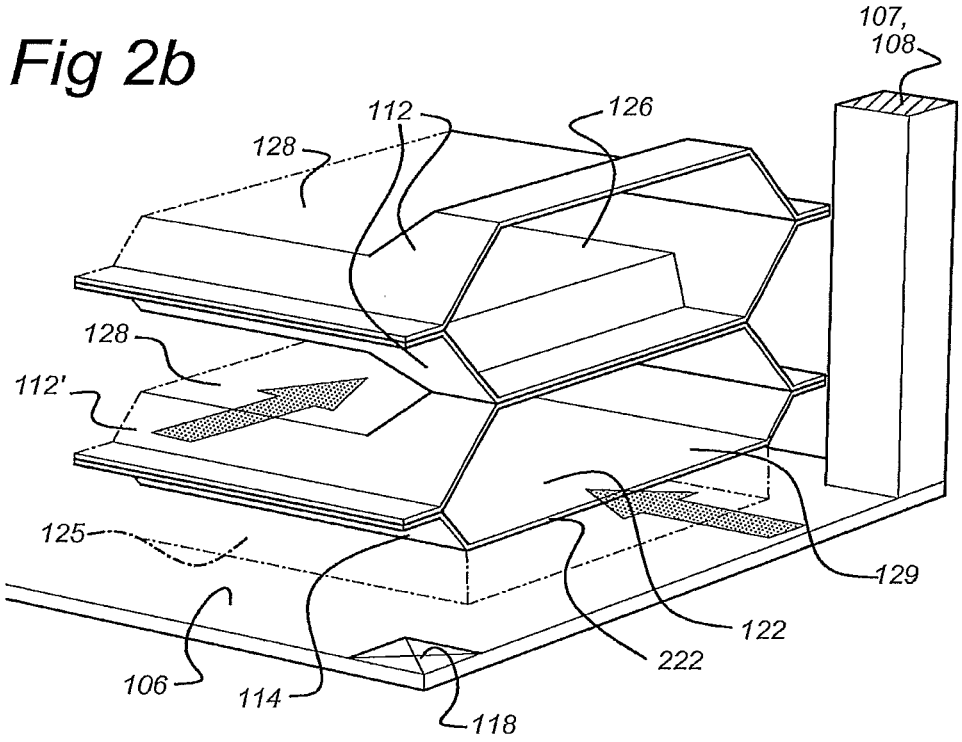

FIGS. 2A and 2B present perspective views of heat exchanger plates in a heat exchanger 102 according to an embodiment. The embodiment shown illustrates specific geometries for a stack of heat exchanger plates 112, 112' and an outer heat exchanger plate 114. Here, heat exchanger plates 112, 112' are formed from quadrilateral plate blanks. The quadrilateral plate blank may have pair of opposing first plate edges 204 and a pair of opposing second plate edges 206. It may have first surface portions 208, with each first surface portion 208 located along one first plate edge 204 and bent to a first heat exchanger plate side 212. The bent first surface portions 208 constitute a first partial fluid channel 216. The quadrilateral plate blank may further have second surface portions 210, each located along one second plate edge 206. The second surface portions 210 may be bent to a second side of the heat exchanger plate 112, forming a second partial fluid channel 218. For example, rectangular plate blanks may be used with parallel opposing first plate edges 204 and parallel opposing second plate edges 206. In particular, doubly bent first surface portions 208 may have two rectangular elongated regions with a bent in the middle, and forming first partial fluid channels 216 that run parallel to the first plate edges 204. Analogously, the second surface portions 210 and resulting second fluid channels 218 may have similar configuration. Such a configuration is illustrated in FIG. 2A.

In alternative embodiments, the heat exchanger plates 112 may be curvedly bent and/or may not be identically shaped along the respective plate edges 204, 206. For example, one or more edges 204, 206 of the heat exchanger plates 112 may have first and/or second surface portions 208, 210 that are not bent to a particular side of a plate. A remaining surface portion may be unbent and coplanar with respect to a main surface portion 219 of the heat exchanger plate 112 (not depicted).

Apart from this, each outer heat exchanger plate 114 may be provided with outer surface portions 220 that are bent towards an outer heat exchanger plate side facing the adjacent heat exchanger plate 112'. The bent outer surface portions 220 form an outer partial fluid channel 224. In FIGS. 2A and 2B, the outer partial fluid channel 224 runs parallel to the first partial fluid channel 216.

FIG. 2B, shows a stack consisting of three heat exchanger plates 112, 112' and an outer heat exchanger plate 114. This stack represents only part of the heat exchanger assembly 104 and is depicted as floating above the end panel contacting region 125, to which the outer main surface portion 122 is to be connected. The joining of the outer heat exchanger plate 114 and the adjacent heat exchanger plate 112' yields the outer fluid channel 129 shown in FIG. 2B.

Advantageously, the heat exchanger assembly 104 according to the embodiment shown in FIGS. 2A and 2B comprises heat exchanger plates 112, 112' and outer heat exchanger plates 114 that require only quadrilateral plate blanks for construction.

In a further embodiment, the plate type heat exchanger 102 has at least one outer heat exchanger plate 114 that is mechanically connected to the adjacent end panel 106 along an outer plate edge 222 that is substantially coplanar with the outer main surface portion 122. A mechanical connection along this plate edge 222 and the end panel 106 provides an attachment that may sufficiently seal the thermally connected faces of the outer main surface portion 122 and the end panel contacting region 125 from the fluids flowing through the outer fluid channel 129. Alternatively or in addition, remaining edges or surface portions of the outer main surface portion 122 may be mechanically connected to the end panel contacting region 125. In general, mechanical connections may be achieved by various conventional methods, such as welding and brazing.

FIG. 3

Figure 3A:
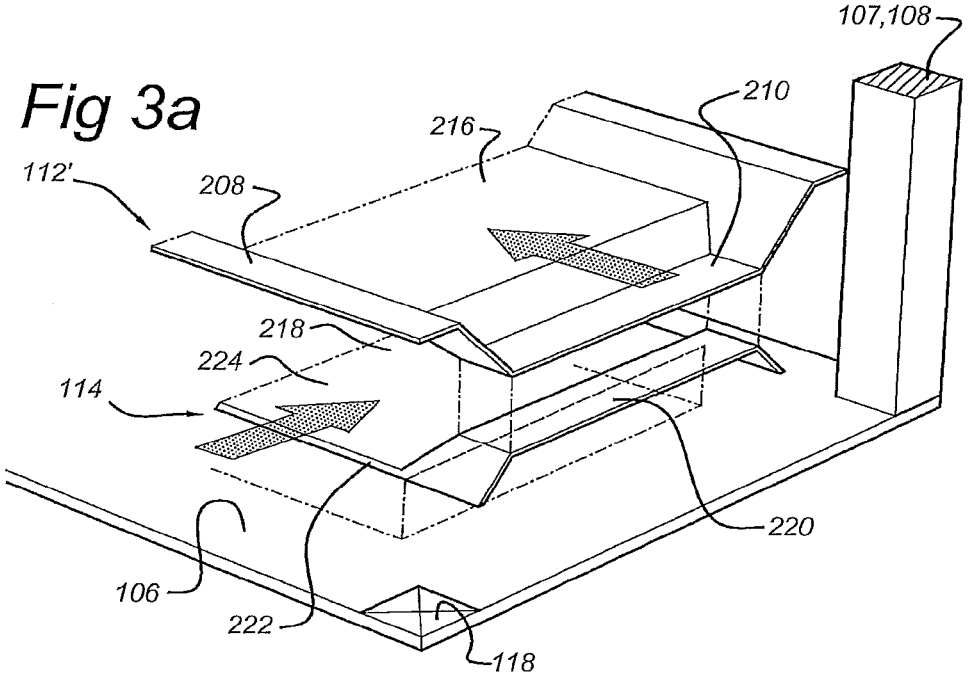
FIGS. 3A and 3B present perspective views of heat exchanger plates in a heat exchanger according to various embodiments.
Figure 3B:
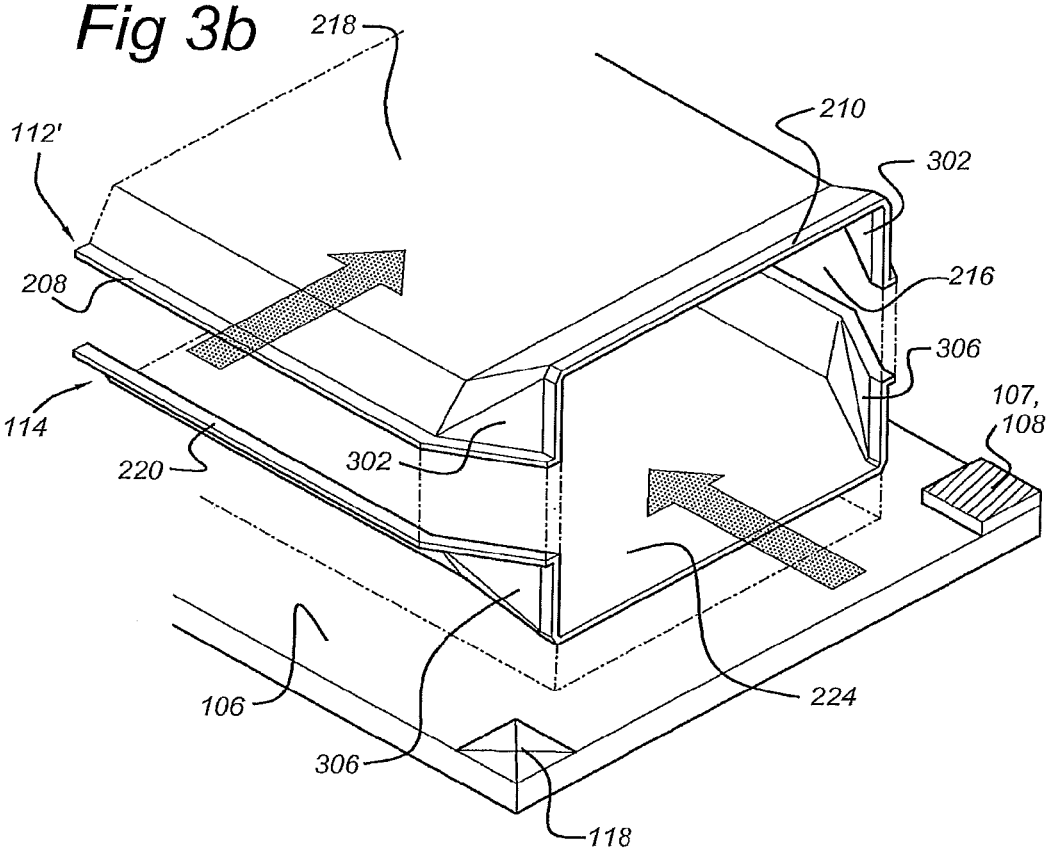

FIGS. 3A and 3B present perspective views of heat exchanger plates 112, 112', 114 in a heat exchanger 102 according to alternative embodiments. FIG. 3A illustrates an embodiment complementary to the embodiment shown in FIG. 2B. In FIG. 3A, the adjacent heat exchanger plate 112' is the in-plane mirror image of the adjacent heat exchanger plate 112' that is shown in FIG. 2A. As a consequence, the outer surface portion 220 of the outer heat exchanger plate 114 in FIG. 3A is located opposite to the second surface portion 210 of the adjacent heat exchanger plate 112'. Similarly, the outer plate edge 222 is located near the first surface portion 208 of the adjacent heat exchanger plate 112'. This embodiment also enables the heat exchanger plates 112, 112' and outer heat exchanger plates 114 to be manufactured from quadrilateral plate blanks.

FIG. 3B illustrates a portion of a plate type heat exchanger, wherein the heat exchanger plates 112 comprise corner surface portions 302 that are bent inwards with respect to the first partial fluid channels 216. The corner surface portions 302 of two joined heat exchanger plates 112 form a first fluid aperture (not shown) with a quadrilateral shape. Furthermore, the outer heat exchanger plate 114 is provided with outer corner surface portions 306 of polygonal shape that are bent towards the outer partial fluid channel 224. The outer corner surface portions 306 of one outer heat exchanger plate 114 and the corner surface portions 302 of the adjacent heat exchanger plate 112' are joined, forming an outer fluid aperture 305 also with a quadrilateral shape. The collection of quadrilateral fluid apertures presents a junction that is easily connectable to a channel for the supply or discharge of fluid. A detailed description on the configuration of bent corner surface portions 302 of the heat exchanger plates 112 is presented in Dutch patent application NL2003983. The outer heat exchanger plates 114 have outer corner surface portions 306 with a polygonal shape, and are constructed from non-quadrilateral plate blanks. The required polygonal shape of the outer corner surface portions 306 require additional chamfering and cutting of the plate blanks, prior to bending the corner surface portions 306 into the outer partial fluid channel 224 with the angular shape shown in FIG. 3B.

In an embodiment of the heat exchanger, the outer surface portion 220 of the outer heat exchanger plate 114 and the first or second surface portions 208, 210 of the adjacent heat exchanger plate 112' may be arranged as touching surfaces. The resulting contacted surface portions may be attached over their entire lengths by means of clamping elements (not shown). Alternatively or in addition, touching surface portions of 208, 210, 220 of the abutting plates 112, 112', 114, may be connected by known methods like welding or brazing.

FIG. 4

Figure 4A:
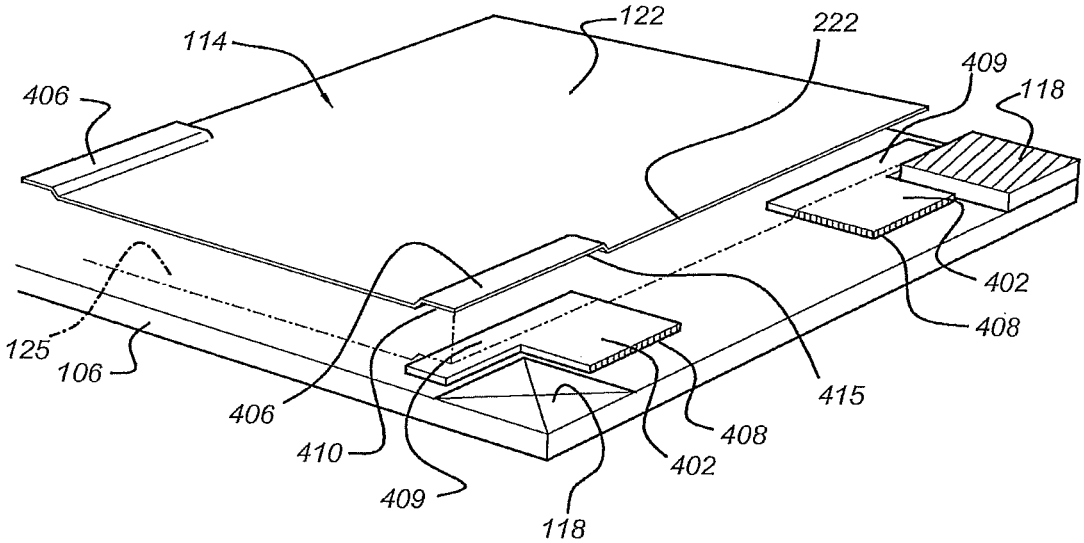
FIGS. 4A and 4B show perspective views of an outer heat exchanger plate detached and attached to an end panel in a heat exchanger according to an embodiment.
Figure 4B:
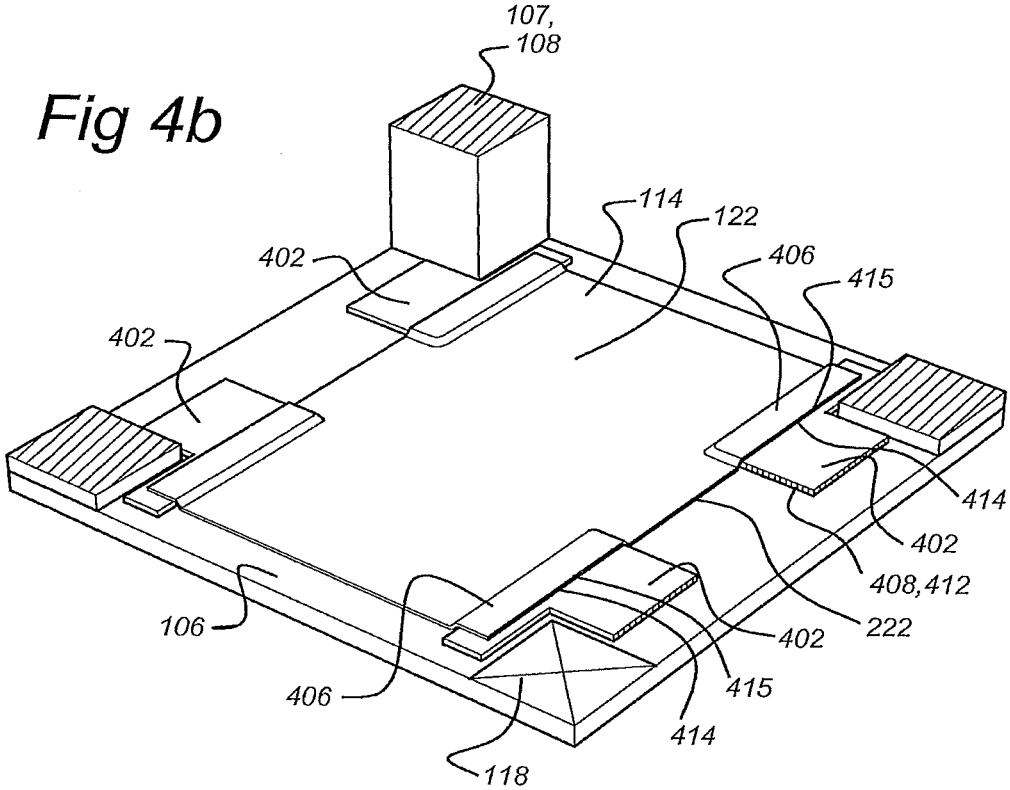

FIGS. 4A and 4B show perspective views of an outer heat exchanger plate 114 detached and attached to an end panel 106 in a heat exchanger 102 according to an embodiment. Despite the remedied in-plane differential expansion, thermal differential expansion between the corner beams 108 and the heat exchanger assembly 104 in a direction perpendicular to the end panels 106 and along the corner beams 108 may still occur. In order to anticipate this perpendicular thermal differential expansion, which is expected to appear in particular between the corner beams 108 and the ribs of the heat exchanger assembly 104 (the vertical ribs shown in FIG. 1), FIGS. 4A and 4B illustrate that the end panel 106 may be provided with a least one flexible corner plate 402. In the embodiment shown in FIG. 4A, two flexible corner plates 402 are each located near a corner beam connection region 118. The flexible corner plate 402 may have a first corner plate connection region 408 that is mechanically connected to the end panel 106 near the respective corner beam connection region 118. The flexible corner plate 402 may further have a second corner plate connection region 409 that is mechanically connected to an outer main surface corner region 406 of the outer heat exchanger plate 114.

In order to enable the flexible corner plate 402 to move perpendicular to the end panel 106, the first corner plate connection region 408 and the second corner plate connection region 409 are non-coinciding. As the first corner plate connection region 408 and the second corner plate connection region 409 may be located on different sides of the flexible corner plate 402, it may suffice that a projection of the first corner plate connection region 408 and a projection of the second corner plate connection region 409, both projected in a plane parallel to the flexible corner plate 402, are non-coinciding. Furthermore, it may suffice that a region of the flexible corner plate 402 is located in-between the (projections of the) first and second corner plate connection regions 408, 409, and/or that the (projections of the) first and second corner plate connection regions 408, 409 only have at most a single point of overlap.

Due to the addition of flexible corner plates 402 as intermediate means of attachments with non-coinciding connection regions 408, 409, the corners of the heat exchanger assembly 104 are allowed to move freely in a direction perpendicular to the end panels 106. A transverse differential thermal expansion perpendicular to the end panel 106 and between the heat exchanger assembly 104 and any corner beam 108 occurring during operation of the plate type heat exchanger 102 is therefore allowed, without causing damage to any of the flexible corner plates 402, the respective mechanical connections or the heat exchanger 102 as a whole.

In an embodiment, the outer main surface corner region 406 is bent towards a side of the outer heat exchanger plate 114 facing away from the end panel 106. This side is directed to the adjacent heat exchanger plate 112', as shown in FIGS. 2A-3B. This bending yields an embossment or saving 410 on the opposite side facing the end panel 106. This saving 410 is suitable for accommodating at least parts of the flexible corner plate 402, in particular when the outer main surface portion 122 is connected to the end panel contacting region 125. This bending of the outer main surface corner region 406 does not necessarily result from a preprocessing of the outer heat exchanger plate 114. In particular, the plate blank from which the outer heat exchanger plate 114 is constructed may be from sheet metal—for example steel with a thickness in the order of 1-2 mm—with sufficient flexible (elastic and plastic deformation) properties for forming the saving 410 upon attachment of the outer heat exchanger plate 114 to the flexible corner plate 402 and the end panel 106. Any gaps that are formed between an outer main surface corner region 406 and a flexible corner plate 402 may be subsequently filled, for example with welding material.

In the embodiment shown in FIGS. 4A and 4B the plate type heat exchanger 102 has first corner plate connection regions 408 comprising corner plate peripheral line regions 412 that are mechanically connected to the end panel 106. In FIG. 4B, it is further illustrated that the second corner plate connection region 409 may comprise a corner plate traversing line region 414 that is mechanically connected to the outer main surface corner region 406. In particular, FIG. 4B shows the corner plate traversing line region 414 being welded to an outer main surface corner edge portion 415 of the outer main surface corner region 406. Preferably, the outer plate edge 222 is partially welded to the end panel 106. In combination with the welded outer main surface corner edge portion 415, which forms a continuation of the outer plate edge 222, the entire outer plate edge 222 of the outer heat exchanger plate 114 in FIG. 4B is welded with a continuous weld seam extending from both corners of the outer main surface portion 122. The remaining edges of the outer main surface portion 122—shown perpendicular to outer plate edge 222 in FIGS. 4A and 4B—may also be welded to the end panel contacting region 125 and/or to the flexible corner plates 402, although this is not required.

FIG. 5

Figure 5A:
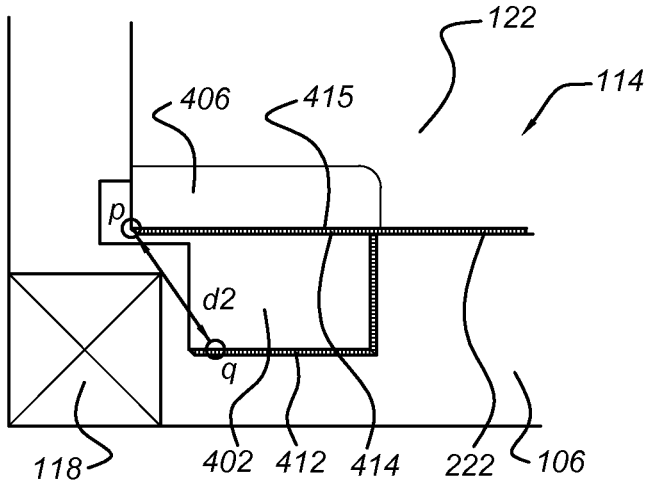
FIGS. 5A and 5B show details on the connection regions of a heat exchanger according to an embodiment.

FIG. 5A further illustrates the previously introduced corner plate peripheral line region 412 and the corner plate traversing line region 414. According to an embodiment, an in-plane distance $d_2$ between a farthermost point p in the corner plate traversing line region 414 and a point q in the corner plate peripheral line region 412 is maximized for all points q in the corner plate peripheral line region 412. This farthermost point p coincides with an extreme point or corner of the outer main surface portion 122 and is assumed to be close to a corner beam 108. In this way, the allowed movement of the flexible corner plate 402 perpendicular to the end panel 106 near the corner beam 108 is maximized.

Figure 5B:
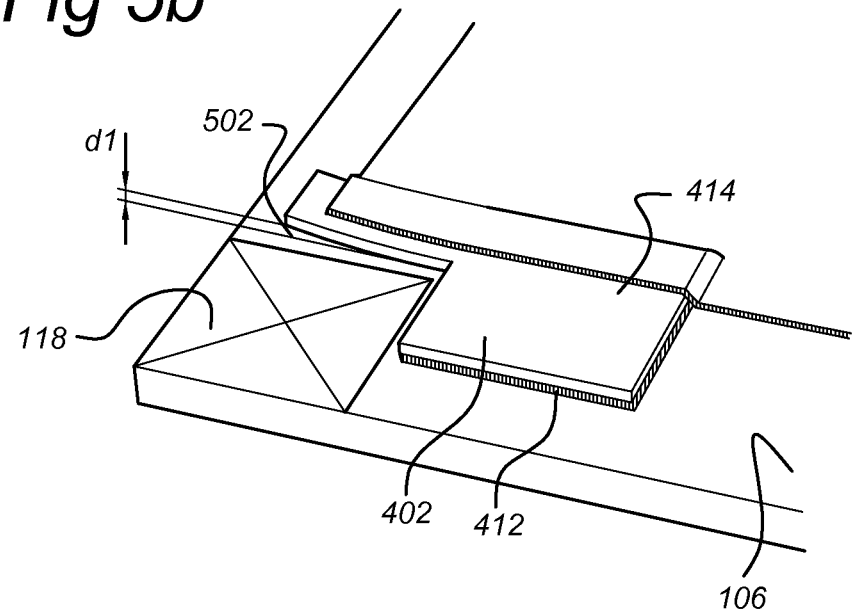

Commonly, a heat exchanger 102 is assembled under conditions that differ from operational circumstances. In particular, the temperature of the heat exchanger 102 in a cold equilibrium state may substantially differ from the temperature distribution present in the operational heat exchanger 102. To remedy this, FIG. 5B shows that the plate type heat exchanger 102 may be further provided with a spacing 502 between the flexible corner plate 402 and the end panel 106. This spacing 502, which is provided during manufacturing of the heat exchanger 102, will enable at least a portion of the flexible corner plate 402 to move a perpendicular distance $d_1$ towards the end panel 106. In a cold state of the heat exchanger 102, the spacing 502 may have a maximal gap-size $d_1$ perpendicular to the flexible corner plate 402 and the end panel 106. This maximal gap-size $d_1$ refers to the largest distance between the flexible corner plate 402 and the end panel 106, which are mechanically connected but not oriented entirely parallel.

A maximal gap-size $d_1$ of 2-3 mm has been found to be sufficient for a cross-flow plate type heat exchanger 102 with (outer) heat exchanger plates 112, 112', 114 with sizes up to 1500·6000 $mm^2$. These steel heat exchanger plates were mounted on end panels 106 with sizes of up to 1800·6300 $mm^2$.

The descriptions above are intended to be illustrative, not limiting. It will be apparent to the person skilled in the art that alternative and equivalent embodiments of the invention can be conceived and reduced to practice, without departing from the scope of the claims set out below.

LIST OF FIGURE ELEMENT

102 plate type heat exchanger
104 heat exchanger assembly
105 frame
106 end panel
107 end panel connection member
108 corner beam
110 stack
112 heat exchanger plate
113 adjacent heat exchanger plate
114 outer heat exchanger plate
116 opposing side
118 corner beam connection region
122 outer main surface portion
124 outer surface
125 end panel contacting region
126 first fluid channel
128 second fluid channel
129 outer fluid channel
134 sealing means
202 quadrilateral plate
204 first plate edge
206 second plate edge
208 first surface portion
210 second surface portion
212 first heat exchanger plate side
214 second heat exchanger plate side
216 first partial fluid channel
218 second partial fluid channel
219 main surface portion
220 outer surface portion
222 outer plate edge
223 outer heat exchanger plate side
224 outer partial fluid channel
302 corner surface portions
303 first fluid aperture
304 second fluid aperture
305 outer fluid aperture
306 outer corner surface portions
402 flexible corner plate
404 end panel corner
406 outer main surface corner region
408 first corner plate connection region
409 second corner plate connection region
410 saving
412 corner plate peripheral line region
414 corner plate traversing line region
415 outer main surface corner edge portion
418 flexible portion
502 spacing
$d_1$ perpendicular distance
$d_2$ in-plane distance
p farthermost point
q point
A plane

The invention claimed is:

1. A plate type heat exchanger, comprising a heat exchanger assembly, end panels and end panel connection members connecting the end panels, wherein the heat exchanger assembly comprises a stack of heat exchanger plates and a pair of outer heat exchanger plates located on opposing sides of the heat exchanger assembly, wherein the end panels are located near the opposing sides of the heat exchanger assembly, wherein at least one outer heat exchanger plate is mechanically connected to an adjacent end panel, and has an outer main surface portion that is facing the adjacent end panel and is substantially entirely thermally connected to an end panel contacting region of the adjacent end panel, and wherein the in-plane thermal expansion properties of the outer main surface portion are substantially identical to in-plane thermal expansion properties of the end panel contacting region, and the plate type heat exchanger is provided with at least one flexible corner plate with a first corner plate connection region that is directly mechanically connected to the end panel near a corner beam connection region, wherein the flexible corner plate has a second corner plate connection region that is directly mechanically connected to an outer main surface corner region of the outer heat exchanger plate, and wherein the projection of the first flexible corner plate connection region and the projection of the second flexible corner plate connection region onto a plane parallel to the flexible corner plate are non-coinciding.

2. The plate type heat exchanger according to claim 1, wherein the stack of heat exchanger plates form first fluid channels and second fluid channels, wherein each outer heat exchanger plate and an adjacent heat exchanger plate that is nearest to the outer heat exchanger plate form an outer fluid channel, and wherein the first fluid channels, second fluid channels and outer fluid channels form spatially separated and thermally connected conduits for conveying fluids.

3. The plate type heat exchanger according to claim 1, wherein the end panel connection members comprise corner beams connecting the end panels in corner beam connecting regions, and wherein a sealing bellows is provided between at least one corner beam and the heat exchanger assembly, the sealing bellows extending between the end panels and along the at least one corner beam, wherein the sealing bellows is arranged to prevent leakage of fluids flowing within the first fluid channels, the second fluid channels and the outer fluid channels while in use.

4. The plate type heat exchanger according to claim 1, wherein the stack of heat exchanger plates are formed from quadrilateral plates having a pair of opposing first plate edges and a pair of opposing second plate edges, and having first surface portions each along one first plate edge and bent to a first heat exchanger plate side resulting in a first partial fluid channel, and second surface portions each along one second plate edge and bent to a second heat exchanger plate side resulting in a second partial fluid channel.

5. The plate type heat exchanger according to claim 1, wherein at least one outer heat exchanger plate is provided with outer surface portions that are bent towards an outer heat exchanger plate side facing away from the end panel, and forming an outer partial fluid channel.

6. The plate type heat exchanger according to claim 5, wherein the at least one outer heat exchanger plate is mechanically connected to the adjacent end panel along an outer plate edge that is substantially coplanar with the outer main surface portion.

7. The plate type heat exchanger according to claim 5, wherein an adjacent heat exchanger plate comprises corner surface portions that are bent inwards with respect to a first partial fluid channel, wherein the at least one outer heat exchanger plate is provided with outer corner surface portions of polygonal shape that are bent towards the outer partial fluid channel, and wherein the outer corner surface portions and the corner surface portions are joined, forming an outer fluid aperture with a quadrilateral shape.

8. The plate type heat exchanger according to claim 1, wherein the outer main surface corner region is bent towards a side of the outer heat exchanger plate facing away from the end panel, thereby defining an embossment on a side of the outer heat exchanger plate facing the end panel, the embossment being suitable for accommodating at least part of the flexible corner plate.

9. The plate type heat exchanger according to claim 1, wherein a spacing is provided between the flexible corner plate and the end panel, allowing a portion of the flexible corner plate to move a perpendicular distance d1 towards the end panel.

10. The plate type heat exchanger according to claim 1, wherein the first corner plate connection region comprises a corner plate peripheral line region that is directly mechanically connected to the end panel.

11. The plate type heat exchanger according to claim 10, wherein the second corner plate connection region comprises a corner plate traversing line region that is directly mechanically connected to the outer main surface corner region.

12. The plate type heat exchanger according to claim 11, wherein the corner plate traversing line region is welded to an outer main surface corner edge portion of the outer main surface corner region.

13. The plate type heat exchanger according to claim 11, wherein a distance d2 between a corner point p of the direct mechanical connection in the corner plate traversing line region and a point q in the corner plate peripheral line region is maximized for any point q of the direct mechanical connection in the corner plate peripheral line region.

14. The plate type heat exchanger according to claim 2, wherein the end panel connection members comprise corner beams connecting the end panels in corner beam connecting regions, and wherein a sealing bellows is provided between at least one corner beam and the heat exchanger assembly, the sealing bellows extending between the end panels and along the at least one corner beam, wherein the sealing bellows is arranged to prevent leakage of fluids flowing within the first fluid channels, the second fluid channels and the outer fluid channels while in use.

15. The plate type heat exchanger according to claim 2, wherein the stack of heat exchanger plates are formed from quadrilateral plates having a pair of opposing first plate edges and a pair of opposing second plate edges, and having first surface portions each along one first plate edge and bent to a first heat exchanger plate side resulting in a first partial fluid channel, and second surface portions each along one second plate edge and bent to a second heat exchanger plate side resulting in a second partial fluid channel.

16. The plate type heat exchanger according to claim 3, wherein the stack of heat exchanger plates are formed from quadrilateral plates having a pair of opposing first plate edges and a pair of opposing second plate edges, and having first surface portions each along one first plate edge and bent to a first heat exchanger plate side resulting in a first partial fluid channel, and second surface portions each along one second plate edge and bent to a second heat exchanger plate side resulting in a second partial fluid channel.

17. The plate type heat exchanger according to claim 2, wherein at least one outer heat exchanger plate is provided with outer surface portions that are bent towards an outer heat exchanger plate side facing away from the end panel, and forming an outer partial fluid channel.

18. The plate type heat exchanger according to claim 3, wherein at least one outer heat exchanger plate is provided with outer surface portions that are bent towards an outer heat exchanger plate side facing away from the end panel, and forming an outer partial fluid channel.

19. The plate type heat exchanger according to claim 4, wherein at least one outer heat exchanger plate is provided with outer surface portions that are bent towards an outer heat exchanger plate side facing away from the end panel, and forming an outer partial fluid channel.

* * * * *